United States Patent [19]

Honda et al.

[11] 4,049,118

[45] Sept. 20, 1977

[54] HOLDING DEVICE FOR ELECTRICAL AND ELECTRONIC PARTS

[75] Inventors: Fumio Honda, Kyoto; Tsuneo Taki, Hakui; Masatoshi Kajiwara, Nagaokakyo, all of Japan

[73] Assignee: Murata Manufacturing Co., Ltd., Kyoto, Japan

[21] Appl. No.: 719,383

[22] Filed: Aug. 31, 1976

[30] Foreign Application Priority Data

Oct. 3, 1975 Japan ..... 50-135858

[51] Int. Cl.[2] ..... B65D 73/02

[52] U.S. Cl. ..... 206/330; 269/321 WE

[58] Field of Search ..... 269/37, 40, 43, 45, 269/321 WR; 29/559, 203 J, 203 B, 25.42; 228/212, 44.1 A; 53/200, 196, 3, 29; 206/330

[56] References Cited

U.S. PATENT DOCUMENTS

| | | | |
|---|---|---|---|
| 3,048,268 | 8/1962 | Rocchi et al. | 206/330 |
| 3,231,082 | 1/1966 | Weiss | 206/330 |

*Primary Examiner*—Al Lawrence Smith
*Assistant Examiner*—Robert C. Watson
*Attorney, Agent, or Firm*—Wenderoth, Lind & Ponack

[57] ABSTRACT

A holding device for holding a plurality of electrical and electronic parts or elements. The holding device of paper or similar resilient material includes a base of tape-like configuration and a plurality of holding portions formed in the longitudinal direction of the base. The holding portion further includes tongue portion formed by a slit which is cut in a direction normal to the longitudinal direction of the base to allow U-shaped lead wires of the electrical parts or elements to be inserted into the base through the slit and to be held in position by pressing the tongue portion into the space defined by the lead wire for efficient handling of such parts and elements as one unit on the base.

10 Claims, 7 Drawing Figures

HOLDING DEVICE FOR ELECTRICAL AND ELECTRONIC PARTS

BACKGROUND OF THE INVENTION

The present invention relates to electrical and electronic components and more particularly, to a holding device for electrical and electronic parts such as registors, capacitors or elements therefor, on which holding device, a plurality of electrical and electronic parts are held, at the lead wire portion thereof, in regular order so that they can be handled as one unit, for example, in the manufacture of such parts or when they are automatically inserted into a printed circuit base and the like.

Conventionally, there has been proposed a lead wire holding device of metallic material for holding electronic parts, for example, in Japanese Utility Model publication No. 42/17229 which includes a metallic supporting member having a plurality of lead wire inserting and holding openings formed therein at regular intervals, and a metallic pressing plate to be engaged with said supporting member. The above described holding device, however, has various disadvantages in that the same device, being made of metallic material, is rather expensive, and is not applicable to electronic parts having distances other than specified between the lead wires. Also high cost is involved for reparing this device.

There has also been proposed another prior art lead wire holding device of paper material which includes a mount of paper onto which lead wires of electronic parts are affixed with adhesive tapes. This holding device, however, also has disadvantages in that the adhesives from the tape tends to adhere to the lead wires and undesirably soils the same, thereby resulting in insufficient application of solder to the lead wires in the soldering process. Furthermore the lead wires cannot readily be positioned at a predetermined distance from each other in an efficient manner, and the electronic parts are not easily removed from the mount once the adhesive tape is applied thereto.

SUMMARY OF THE INVENTION

Accordingly, an essential object of the present invention is to provide a holding device for electrical and electronic parts which is capable of holding a plurality of such parts in an efficient manner for enabling the same parts to be handled as one unit in the manufacture thereof or when such parts are to be automatically incorporated into printed circuit bases and the like, with substantial elimination of disadvantages inherent in the conventional holding devices of this kind.

Another important object of the present invention is to provide a holding device for electrical an electronic parts of the above described type on which lead wires of the parts can be accurately positioned at predetermined intervals in such a manner that the same parts do not easily come off the holding device and yet can readily be removed therefrom with a predetermined minimum force.

A further object of the present invention is to provide a holding device for electrical and electronic parts of the above described type which is simple in construction and can be manufactured at low cost.

According to a preferred embodiment of the present invention, the holding device of paper or resilient paper-like material includes a base in the form of strip or tape, a raised portion or stepped portion formed, for example, by shaping at the central portion of the base in a longitudinal direction of said base, and tongue portions formed by nicks made adjacent to the raised portion in a direction normal to the longitudinal direction of the base. The U-shaped lead wires of the electrical or electronic parts or elements therefor are inserted into the nicks through the under side of the raised portion, while the tongue portions are pressed into the space defined by each of the lead wires for tightly holding the lead wires between the edges of the tongue portions and the nicks. By the above arrangement, a holding device of inexpensive material capable of holding a plurality of electrical and electronic parts firmly at correct predetermined intervals and yet releasing such parts therefrom at a predetermined force in an efficient manner is advantageously presented, thus making it possible to handle these parts as one unit in the manufacturing or other related processings therefor.

BRIEF DESCRIPTION OF THE INVENTION

These and other objects and features of the present invention will become apparent in the following description taken in conjunction with a preferred embodiment thereof with referene to the attached drawings in which.

Figure 1:
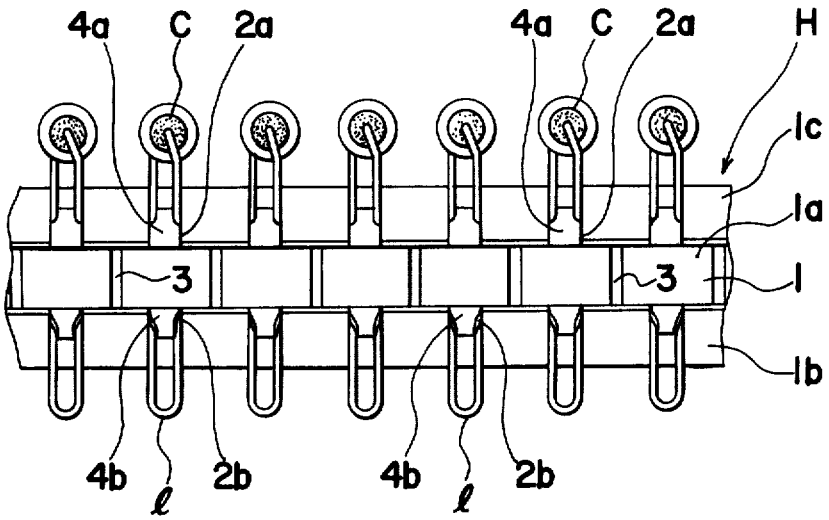
FIG. 1 is a fragmentary top plan view of a holding device according to the present invention with elements of electronic parts mounted thereon.
Figure 2:
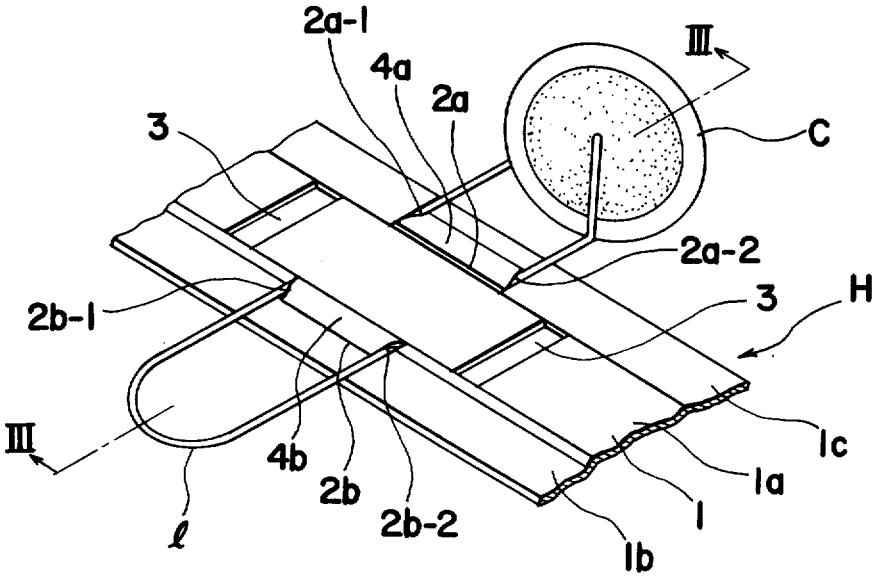
FIG. 2 is a perspective view showing, on an enlarged scale, of one lead wire holding means employed in the device of FIG. 1.
Figure 4:
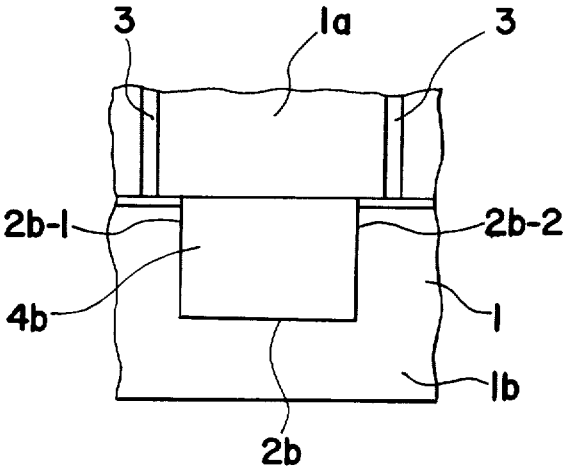
Figure 5:
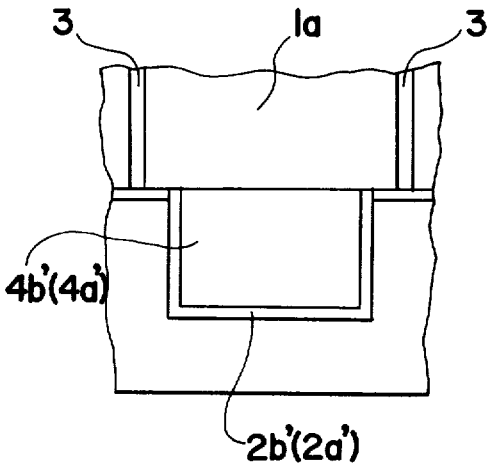

FIGS. 3(A) to 3(C) are sectional views taken along the line III—III of FIG. 2 sequentially showing insertion of the lead wire and holding thereof on a base of the holding device of FIG. 1;

FIG. 4 is a fragmentary top plan view showing, on an enlarged scale, a nick and corresponding tongue portion formed in the device of FIG. 1, and FIG. 5 is a similar view to FIG. 4, but particularly shows modification thereof.

DETAILED DESCRIPTION OF THE INVENTION

Before the description of the present invention proceeds, it is to be noted that like parts are designated by like reference numerals throughout several views of the accompanying drawings.

Figure 3:
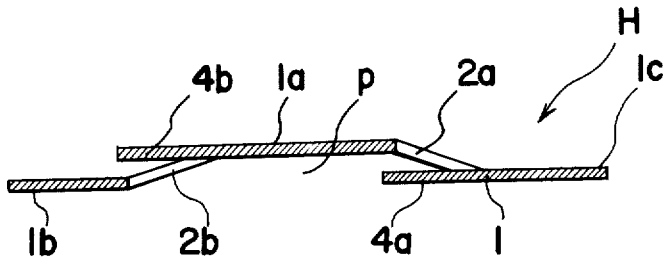
Figure 3:
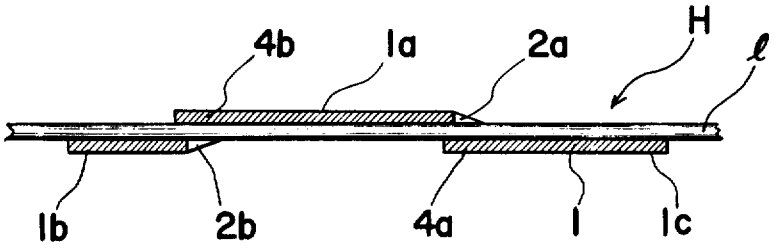
Figure 3:
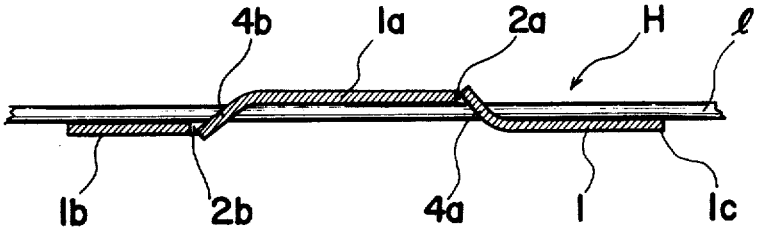

Referring now to FIGS. 1 to 3(C), there is shown a holding device H for electrical and electronic parts or elements therefor according to the present invention which includes a base or mount 1 made of paper, resilient canvas or the like of proper thickness in the form of a strip or a tape wound into roll shape (not shown). Axially formed, for example, by shaping in the central portion of the base 1 is a raised or stepped portion 1*a* which is provided with a plurality of rectangular slits or perforations 3 arranged at regular intervals and formed in a direction normal to the longitudinal direction of the base 1 for engagement, for example, with a sprocket of an automatic feeding apparatus (not shown). It should be noted here that the configuration of the slits or perforations 3 is not limited to the rectangular shape, but may be altered to any other shapes, for example, to circular configuration. In the opposite side edges 1*b* and 1*c* of the base 1 adjacent to the raised portion 1*a* thereof, are a plurality of pairs of opposed rectangular slits 2*a* and 2*b* in positions between the neighboring perforations 3 constituting corresponding tongue portions 4a and 4b of rectangular shape thereat. The slits 2a and 2b are formed by linear cut so that the tongue portion 4a extends from the side edge 1c toward the raised portion 1a, while the tongue portion 4b extends from the raised portion 1a toward the side edge 1b. It should be noted here, however, that both of the tongue portions 4a and 4b may be modified to extend either from the raised portion 1a toward the side edges 1b and 1c or from the side edges 1b and 1c toward the raised portion 1a, and that either one of the tongue portions 4a and 4b may be replaced by a rectangular opening formed, for example, by blanking. Since the base 1 has the longitudinal raised portion 1a provided thereon as described earlier, the free edges of the tongue portions 4a and 4b formed by the slits 2a and 2b are initially spaced from the base 1 to form a passage *p* under the raised portion 1a as is most clearly seen in FIG. 3(A) for receiving therein a lead wire *l* for an element C of an electronic part. The lead wires *l* each U-shaped and holding the element C of the electronic part at one end thereof, are inserted into the respective pairs of slits 2a and 2b through the passage *p* under the raised portion 1a in a direction normal to the longitudinal direction of the base 1 as shown. The construction of the base 1 thus constituted maked it extremely easy to pass the straight lead wires *l* therethrough. After insertion of the lead wire *l* in the above described manner (FIG. 3(B)), the tongue portion 4a is pushed or bent upward, while the tongue portion 4b is pressed downward through a space defined by the U-shaped lead wire *l* as shown in FIG. 3(C), thus the lead wire *l* is tightly held between the side edges of the tongue portion 4a and the corresponding edges 2a-1 and 2a-2 of the slit 2a and also between the side edges of the tongue portion 4b and corresponding side edges 2b-1 and 2b-2 of the slit 2b. Accordingly, soldering of the lead wires *l* to the electrodes of the elements C held between the ends of the same lead wires *l*, and subsequent processings therefor can be readily effected, with the base 1 being handled as one unit.

It should be noted here that the slits 2a and 2b described as rectangular in shape in the above embodiment may be modified to any other shaped, for example, to U shape or the like, provided that such slits and corresponding tongue portions formed thereby serve the purpose for firmly holding the U-shaped lead wires.

It should also be noted that each of the slits 2a and 2b described as formed by the linear cut as in FIG. 4 in the above embodiment may be modified to be formed as a wider cut-out groove 2b' or 2a' of 0.5 to 0.6mm wide as shown in FIG. 5 to form a corresponding tongue portion 4b' or 4a'. Needless to say, the configuration of the rectangular cut-out groove 2b' or 2a' in FIG. 5 may also be modified to any other shapes in the similar manner as in the slits 2a and 2b.

As is clear from the foregoing description, since the holding device of the invention employs inexpensive paper or the like as the base, while requiring no adhesive tapes, the same holding device is by far less expensive than the conventional metallic holding devices or even the known holding devices of paper-like material. Furthermore, the arrangement in the device of the invention wherein the tongue portions are pressed into the spaces defined by the lead wires for holding the same lead wires between the tongue portions and the corresponding edges of the nicks is very effective not only for positioning the lead wires accurately at predetermined distances, but for positive holding of the electronic part elements by the lead wires which are tightly held in position in the above described manner. Moreover, while the electronic parts do not easily fall off from the base of the holding device, the same parts can readily be withdrawn from or inserted into the base. Additionally, in the holding device of the invention, the disadvantages in the conventional holding devices of paper-like material such as soiling of lead wires by the adhesives or peeling of the adhesive tapes during use due to the influence of heat are advantageously eliminated. Another advantage of the holding device of the invention which is also applicable to automatic production machines is that a plurality of electrical and electronic parts mounted on the base can be handled as one unit in the manufacturing of such parts and when such parts are inserted, for example, into a printed circuit base.

It is needless to say that, in the foregoing embodiment, although the holding device of the invention is mainly described with reference to small sized electronic parts or elements therefor, the concept of the present invention is not limited in its application to such small sized parts or elements, but may be readily applicable to the manufacture and handling of any other components, parts and elements in general for efficient handling of the same.

Although the present invention has been fully described by way of example with reference to the attached drawings, it is to be noted that various changes and modification are apparent to those skilled in the art. Therefore, unless otherwise such changes and modifications depart from the scope of the present invention, they shouold be construed as included therein

What is claimed is:

1. A holding device for holding therein a plurality of electrical and electronic components at the lead wire portions thereof with regular intervals thereinbetween, said holding device comprising:

a base member of tape-like configuration;

a plurality of holding means for holding said electrical components spaced from each other longitudinally along said base member, each holding means comprised of:

a first hinge-like tongue member cut from said base member perpendicular to the longitudinal direction of said base member, whereby said lead wires can be inserted into said base member through said cut therein and held therein by said tongue member pressed into said cut and forcing said lead wires between the side of said tongue member and said cut.

2. A device as claimed in claim 1 wherein:

said base member has a raised portion in the central, longitudinal direction thereof, said raised portion having first and second side portions opposite each other and a top portion between said side portions;

said first tongue members are cut from said first side portions; and said raised portion has a plurality of openings cut therein through said second side portion opposite said first tongue members formed in said first side portion.

3. A device as claimed in claim 2 wherein said openings cut into said second side portion form a plurality of second hinge-type tongue members opposite said first tongue members.

4. A device as claimed in claim 3 wherein said first tongue members extend outward from said top portion and said second tongue members extend upward from said second side portion toward said top portion.

5. A device as claimed in claim 3 wherein both said first and second tongue members extend outward from said top portion.

6. A device as claimed in claim 3 wherein both said first and second tongue members extend upward from said side portions toward said top portion.

7. A device as claimed in claim 3 wherein said first and second tongue members are formed by narrow, slit-like cuts in said base member.

8. A device as claimed in claim 3 wherein said first and second tongue members are formed by groove-like cuts of 0.5 to 0.6 mm width in said base member.

9. A holding device as claimed in claim 1, wherein said base member is of paper material.

10. A holding device as claimed in claim 1, wherein said base member is of resilient canvas material.

* * * * *